United States Patent [19]

Kirby et al.

[11] 4,248,012

[45] Feb. 3, 1981

[54] LANE CHANGING CAR

[76] Inventors: James S. Kirby, 2222 Gates Ave., Redondo Beach, Calif. 90278; Lawrence Jones, 8125 Zitola Ter., Playa Del Rey, Calif. 90291; Walter Moe, 13039 Sky Valley Rd., Los Angeles, Calif. 90049; Charles M. Diker, 944 Fifth Ave., New York, N.Y. 10021

[21] Appl. No.: 973,139

[22] Filed: Dec. 26, 1978

[51] Int. Cl.[3] ..... A63H 17/36

[52] U.S. Cl. ..... 46/262; 46/253; 273/86 B

[58] Field of Search ..... 46/262, 251, 259, 258, 46/261, 253–256, 257, 210, 213; 273/86 B, 86 R; 104/60

[56] References Cited

U.S. PATENT DOCUMENTS

| | | | |
|---|---|---|---|
| 1,332,545 | 3/1920 | DeFilippis | 46/213 |
| 2,109,403 | 2/1938 | Roussy et al. | 46/262 X |
| 2,167,245 | 7/1939 | Lohr et al. | 46/210 |
| 2,862,332 | 12/1958 | Johnson | 46/262 X |
| 3,027,682 | 4/1962 | Schlau | 46/259 X |
| 3,555,726 | 1/1971 | Okuma | 46/253 |
| 3,675,366 | 7/1972 | Tomiyama | 46/262 |
| 3,813,812 | 6/1974 | Barlow et al. | 46/259 |
| 4,156,987 | 6/1979 | Lahr | 46/259 X |

FOREIGN PATENT DOCUMENTS

| | | | |
|---|---|---|---|
| 1038469 | 9/1958 | Fed. Rep. of Germany | 46/262 |
| 2722734 | 11/1978 | Fed. Rep. of Germany | 46/262 |
| 2817441 | 10/1979 | Fed. Rep. of Germany | 46/262 |

*Primary Examiner*—Robert Peshock
*Assistant Examiner*—Mickey Yu
*Attorney, Agent, or Firm*—Amster, Rothstein & Engelberg

[57] ABSTRACT

A miniature toy steerable car uses the selective direction of rotation of the motor to effectively steer the front wheels of the vehicle. A reversible motor selectively drives one of a pair of rear wheels by means of a gear arrangement and one-way drive mechanisms such that one or the other of the rear wheels of the vehicle acts to drive and propel the vehicle in a forward direction. The motor is coupled with a front wheel steering mechanism which causes the front wheels to turn in one direction when the rotation of the motor is clockwise and causes the front wheels to turn in the other direction when the rotation of the motor is reversed or made to rotate counterclockwise.

7 Claims, 6 Drawing Figures

FIG. 4
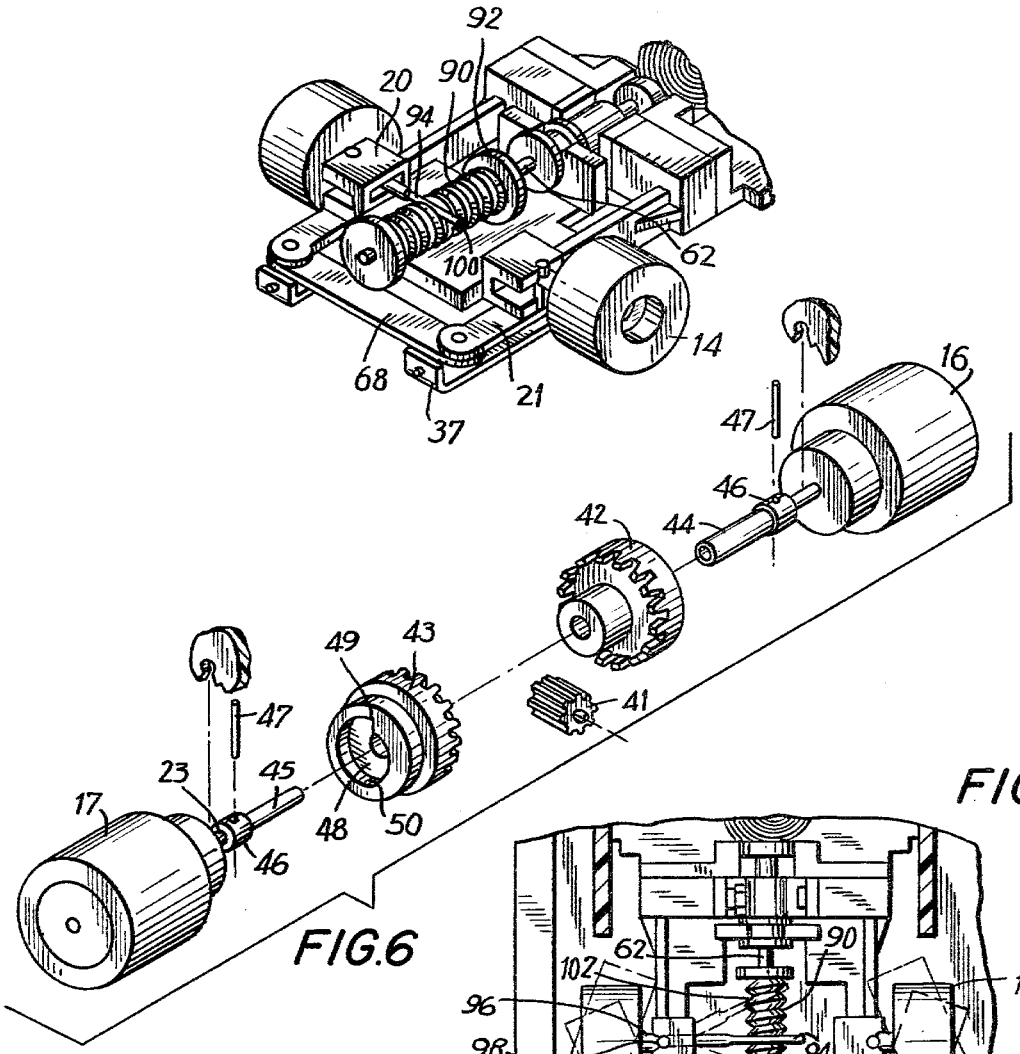
FIG. 6
FIG. 5
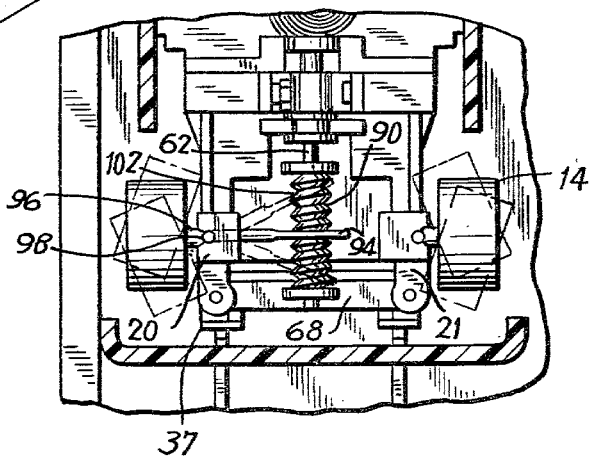

LANE CHANGING CAR

BACKGROUND OF THE INVENTION

This invention generally relates to a miniature toy steerable vehicle. The invention specifically relates to an improved steerable car which utilizes the selective reversibility of the directions of armature rotation of its electric motor to turn the front wheels and thus allow the car to change lanes when and where desired. Power is provided to the car from an external source of electric current. The track upon which the car is intended to be driven is provided with conventional contact rails running along the entire length of track. Electrical contact pick-up shoes, also old in the art, are provided on the underside of the car and ride directly upon the contact rails. The track is of the "slotless" type and, therefore, the operator can cause the vehicle to change lanes whenever desired.

Since the track is slotless, a delicate balance between the weight of the car and the power of the car must be struck. In slotless cars, as the weight of the vehicle increases, the vehicle will exhibit a greater tendency to spinout when it travels around a curve. This means that the operator must manually replace the car so that the pick-up shoes are indexed above the track's electrical rails. Obviously, this is undesired. On the other hand, the vehicle must have a motor of sufficient bulk so that power and thus speed is provided. Generally, the operator of the toy system tends to derive greater enjoyment from the toy as the speed of the cars are increased. The steering mechanism described herein is small enough to allow use in toy vehicles typically in the HO scale size range. It is, therefore, an object of the present invention to provide a front wheel steering mechanism of small size and weight.

DESCRIPTION OF THE PRIOR ART

Many types of toy electric motor driven vehicles are in use today. The most widely known is the slot car variety which is used in conjunction with a slotted track having electrically conductive pick up rails for supplying power to the motors of the cars. Other types of motor driven toy cars include those in which power is supplied through wires coupled directly to the car. Slot cars are guided over a fixed path by the slot in the track upon which they are operated. They suffer from the basic disadvantage of restricting the travel path of the car to the slots provided. The provision of a slot necessarily deprives the user of the freedom or ability to change lanes at any point along the track. More specifically, the slot prevents the user from having the freedom to steer the vehicle as desired. The user of a car driven on a slotted track can only change lanes at an intersection which allows a cross over of the cars.

Toy car systems have also been operated upon slotless tracks. Operating the vehicle upon this type of track allows the user to select the position of the car upon the track when a lane change is to be effected. Slotless track which is provided with electrical contact rails is old in the art. The cars which travel upon slotless tracks have been provided with front wheel steering mechanisms. However, the steering mechanisms used in those cars (generally employing a solenoid or other electrical arrangement) are bulky and contribute significant weight. These vehicles thus exhibit a greater tendency to spinout than a simpler and lighter steering mechanism.

A steerable toy vehicle is described in U.S. Pat. No. 3,453,970 wherein a freely mounted d.c. motor transmits torque to effect steering. When the voltage applied to the motor is reversed, the housing of the vehicle rotates slightly thereby turning the steering mechanism while still maintaining electrical contact. This vehicle is intended for a slotted track and a lane change can only occur at predetermined intersections. The inability of the user to change lanes whenever desired is a significant disadvantage of the prior art. The toy vehicle described in U.S. Pat. No. 3,453,970 teaches the use of a crown gear and one-way clutch arrangement so that the rear wheels will drive the car forwardly irrespective of the direction of the rotation of the motor.

SUMMARY OF THE INVENTION

The present invention comprises a miniature toy steerable race car intended to be driven upon a slotless track provided with exterior side walls. The track is provided with electrical contact rails and the vehicle with pick-up shoes. The car basically comprises a chassis with a selectively reversible motor. The motor is powered by an external source of electrical power which is connected to the car via the contact rails and electrical pick-up shoes. A pair of front wheels are pivotally attached to the chassis to steer the vehicle as desired. Selectively, one of the rear wheels of the vehicle powers the car. A transmission mechanism is provided such that only one of the rear wheels at any given time is driven by the rotation of the motor, the other wheel freely rotating forwardly. When the rotation of the motor is reversed, the previous free-wheeling rear wheel becomes the driving wheel and the first driving rear wheel will then freely rotate forwardly. Thus, depending upon the rotation of the motor, one of the rear wheels will be the driving wheel while the other rear wheel will freely rotate forwardly. The selection of the rear driving wheel aids in steering the vehicle. For example, if the motor is rotating in a first direction which causes the right rear wheel to be the driving wheel with the left rear wheel freely rotating, then the front of the vehicle will tend to turn toward the right. Reversing the direction of rotation of the motor facilitates selective steering of the car. The selection of the rear driving wheel provides some steering function to the car, but it is, by itself, inefficient and relatively slow.

In toy car racing, it is extremely desirable for the operator of a particular car to be capable of switching from one lane to another lane at any point along the track in a minimum amount of time. The prior art described above discloses a reversible electric motor which can cause the vehicle to steer right or left by means of the rear wheel transmission arrangement previously described. However, vehicles which employ this method of steering respond slowly to the reversing of the motor and are therefore not as desirable as the present invention which causes the car to respond significantly more quickly to a reverse of the direction of rotation of the motor. The present invention utilizes the reversibility of the motor to not only cause the selection of the desired rear wheel to drive the car in the direction desired but also to cause the front wheels to change direction and steer the vehicle as desired. Therefore, reversing the rotation of the motor serves to change the driving rear wheel and, in addition, changes the direction of the front wheels so that a change of lane can be accomplished in a minimum amount of time.

The present invention utilizes a mechanical arrangement to turn the front wheels as desired. The front wheel steering means is lightweight and, therefore, while adding some weight to the vehicle, will not significantly increase the car's propensity for spinouts. The present front wheel steering means is far simpler and less bulky than the prior art steering means which employ solenoids, magnets, diodes, etc., to effectuate lane changes.

Basically, the present invention provides that the rotation of the armature of the motor be transmitted to a shaft, said shaft rotating in the direction of rotation of the motor. Reversing the rotation of the motor reverses the rotation of the shaft and causes a lateral displacement of a front wheel tie bar which turns the front wheels. The tie bar serves to operatively couple the front wheels so that they are always maintained in a parallel relationship. The car will thus change lanes and continue in the forward direction since electrical current is provided to the car as soon as the vehicle is aligned with the new lane electrical contact rails. The alignment of the pick-up shoes and the contact rails is accomplished by the lane guide system.

In one embodiment, a worm gear is rotated with the motor. A pivotal directional rod, attached to the axle of one of the front wheels, travels in the grooves, i.e., between the threads of the worm gear. When the rotational direction of the armature of the motor is reversed, the free end of the directional rod travels to the other end of the worm gear thereby causing the front wheels to turn in the opposite direction.

It is an object of the present invention to provide a relatively simple and inexpensive arrangement for enabling a toy motor driven vehicle to be steered effectively with a minimum amount of response time.

It is a further object of the invention to provide a steerable car which is capable of changing lanes at any point along a track.

It is an additional object of this invention to provide a mechanical and lightweight front wheel steering means.

It is also an object of this invention to provide a means limiting the extent that the front wheels can turn.

These and other objects and features of the invention will become more apparent upon reference to the following description taken in conjunction with the drawings.

BRIEF DESCRIPTION OF THE DRAWINGS

FIG. 4 is a partial perspective view of the preferred embodiment of the steering mechanism for the car;

FIG. 5 is a top plan view of the embodiment shown in FIG. 4 with ghost lines indicating movement of the wheels and directional rod; and FIG. 6 is an exploded perspective view of the rear axle assembly.

DETAILED DESCRIPTION OF THE DRAWINGS

Figure 1:
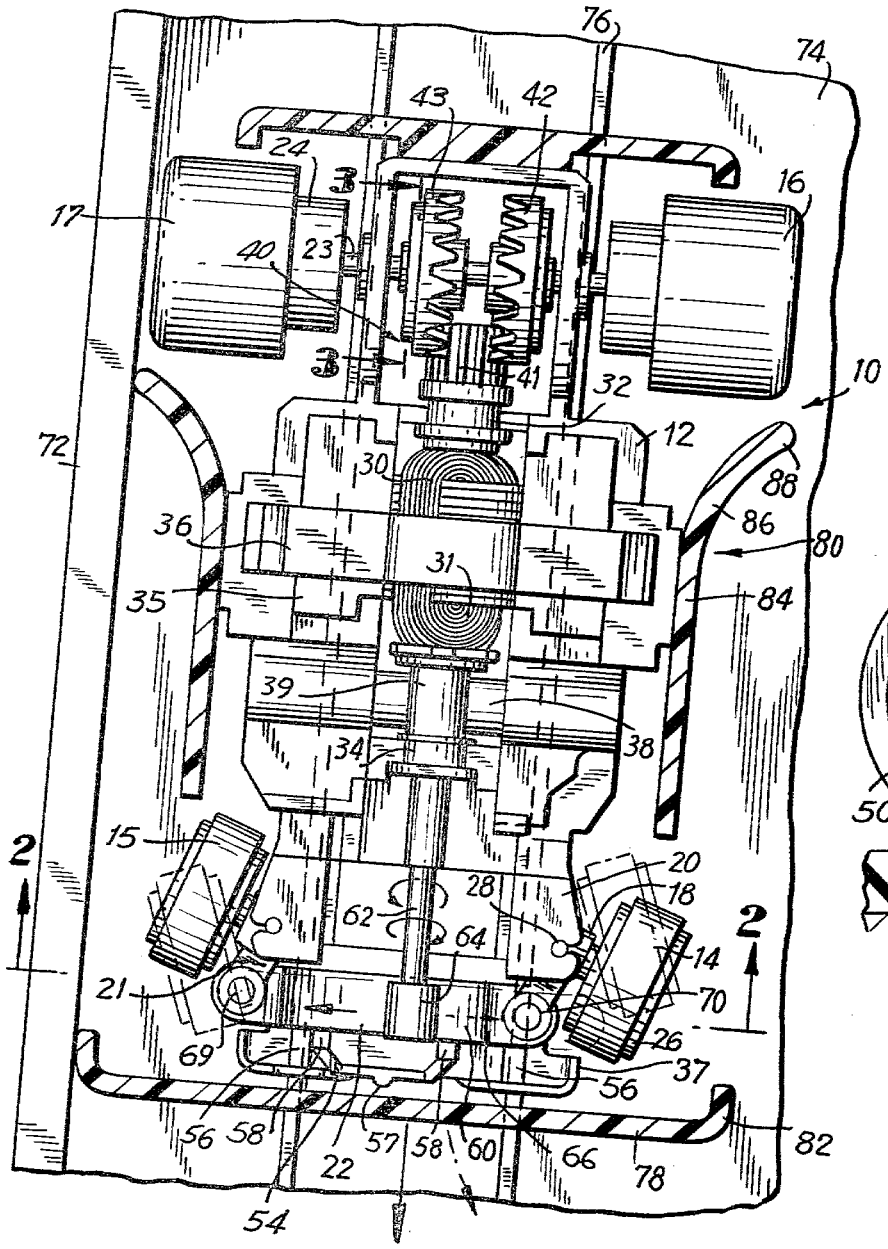
FIG. 1 is a plan view of a car and lane of track with the body of the car removed, and clearly illustrates an embodiment of the present invention.
Figure 3:
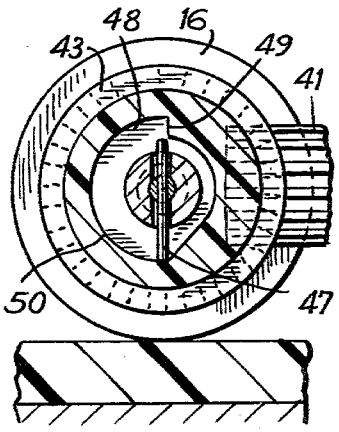
FIG. 3 is a cross-sectional view taken along lines 3—3 of FIG. 1 and illustrates one form of a one-way clutch arrangement for the rear driving wheels of the car.
Figure 2:
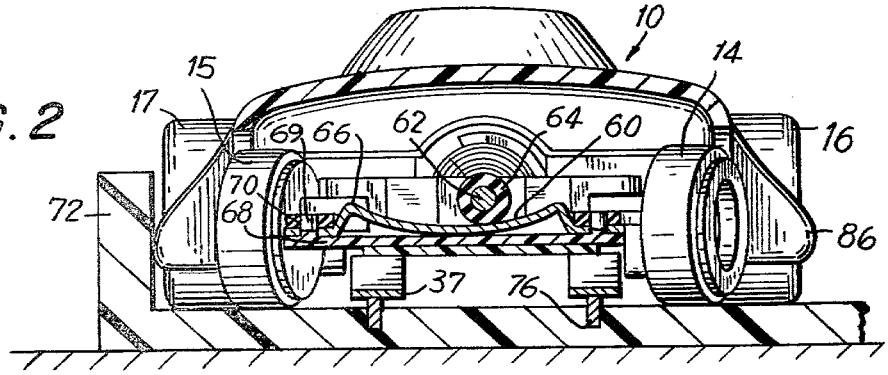
FIG. 2 is a front cross-sectional view of the car, with the body of the car in place, taken along lines 2—2 of FIG. 1 and illustrates the same embodiment of the present invention, as shown in FIG. 1.

As best seen in FIG. 1, a toy car 10, shown for clarity of illustration with its body removed, has a chassis 12. The car 10 is provided with a pair of front wheels 14, 15 and a pair of rear wheels 16, 17. The car has an electrical motor 30, transmission means 40 for providing power to a selected one of the rear wheels, and front wheel steering means 60.

A pair of front wheels 14 and 15 are pivotally connected to the chassis 12 by support bars 18 at pivot pins 28 of the support bars. The front wheels 14 and 15 can fully rotate while being supported by support bars 18. Support bar housings 20, formed from the chassis, each provide an upper and lower aperture for the pivot pins 28 of the support bars 18. The front wheels are capable of rotating freely in the direction of travel and also turn about pins 28 so as to steer the car within predetermined limits, more fully described hereinafter. The front wheels 14 and 15, preferably of a rubber composition, are mounted on front wheel drums 26. The support bars 18 possess an L-shape and are pivotable with respect to chassis 12 about pivot pins 28. The front wheel drums are rotatably mounted on one leg of the support bars 18. The other legs 21 of the support bars 18 are connected to one another by a tie bar means 22. In this manner, it will be appreciated that the front wheels will always be maintained in a parallel relationship with respect to one another. Also to be appreciated is the fact that a force tending to turn only one of the front wheels will correspondingly turn the other front wheel in an equal amount.

Freely rotatable rear axles 23 pass through and are supported by the chassis 12. The rear axles support the rear wheel drums 24. Rotation of the axles rotates the wheel secured thereto. Rubber rear wheels 16 and 17 are adhesively or otherwise conventionally secured on the rear wheel drums 24.

An electrical motor is mounted on the chassis. Rotation of the armature 31 and a rearwardly extending shaft of the motor 30, is allowed by rear shaft bearings 32 and front shaft bearings 35 both in the form of rings which are mounted in appropriate lugs or bosses in the chassis 12. In this manner, free rotation of the armature 31 is provided. Permanent magnets 35 are provided on both sides of the motor and a retaining bar or clip 36 serves to secure the motor and magnets in place. Electrical pick-up means, or shoes 37, electrically connect the motor to an external source of electrical current. Brushes 38 are provided as is a commutator 39 which freely rotates between the brushes 38. The above description of the motor is conventional and fully described in the prior art.

The transmission means 40 serves to transmit forward driving power and mechanically connects the rotation of the armature 31 of the motor 30 to the rear wheels 16 and 17. The transmission means, irrespective of the direction of the rotation of the armature 31, drives the car 10 forwardly. Rotation of the armature 31 rotates a shaft extending through rear shaft bearing 32. A pinion gear 41 is mounted upon the rearwardly extending shaft and rotates therewith. A pair of opposed crown gears 42 and 43 are provided on both sides of the pinion gear 41 and mesh therewith.

As best seen in FIGS. 1 and 6, the axle 23 of one of the rear wheels 16 is provided with a cylindrical sleeve 44. The other axle 23 of rear wheel 17 has a cylindrical extension 45. The outside diameter of cylindrical extension 45 is less than the inside diameter of cylindrical sleeve 44. The cylindrical extension 45 freely rotates within cylindrical sleeve 44. Thus, the two rear axles 23 will rotate independently of one another. The crown gears 42 and 43 are freely mounted on cylindrical sleeve 44.

Mounted on the interior ends of both rear axles 23 are cylindrical fittings 46. Each fitting is provided with a bore through which a pin 47 freely slides. The crown gears 42 and 43 are identical. On the exterior side of each crown gear, i.e., opposite the gear teeth, the gear is provided with a recessed cavity 48. The cylindrical fitting 46 with its pin 47 fits within recessed cavity 48. The cavity 48 is provided with a flat 49 and shaped curved wall 50. The crown gear with its cavity, the fitting, pins, and rear axle operates a one-way clutch mechanism, sometimes referred to as an overriding clutch.

Rotation of the right crown gear 43 in a first direction, e.g., clockwise, as viewed from the right of the car, causes curved wall 50 to push pin 47 through the bore so that one end of the pin abuts against the flat 49. Rotation of the flat 49 of the cavity 48 pushes the pin in a clockwise direction. Since the pin 47 is held within fitting 46, rotation of the pin causes the fitting, the axle, and the wheel 17 to rotate. In this manner, the rear wheel 17 is driven forwardly in a clockwise direction. Thus, rotation of crown gear 43 in a clockwise direction drives rear wheel 17 forwardly. At the same time, however, crown gear 42 is rotating counterclockwise, as viewed from the right of the car. Pin 47 of the left wheel 16 will slide back and forth within the bore of the fitting 46. The pin 47 will not abut against the flat 49 but, rather, performs in a ratchet-type manner, and, therefore, the axle with its rear wheel 16 will not be driven rearwardly. Rather, the wheel 16 will freely rotate, although not driven, in the forward direction of the car.

Obviously, if the left crown gear 42 is rotated clockwise, when viewed from the right of the car, then the left rear wheel 16 will be the driving wheel and the right rear wheel 17 will freely rotate forwardly.

Another example of a one-way clutch mechanism which causes one of the rear wheels to be driven while the other wheel freely rotates is described in U.S. Pat. No. 3,453,970.

It should be obvious that rotation of the armature 31 of the motor 30 in a first direction will cause the pinion gear 39 to rotate in either the clockwise or counterclockwise direction, as viewed from the front of the car. Irrespective of the direction of armature rotation, the pinion gear 39 causes the crown gears 42 and 43 to rotate in opposite directions with respect to one another. However, even though one crown gear will rotate such that the corresponding rear wheel attached to the axle would, but for the one-way clutch rotate and be driven rearwardly, only one of the wheels 16 or 17 will, in fact, be driven by the rotation of the pinion gear while the other wheel will merely free wheel. This is obviously due to the one-way clutch mechanism just described. Thus, the direction of rotation of the armature 31 of the motor 30 will cause either one or the other of the rear wheels, i.e., 16 or 17, to drive in a forward direction while the other rear wheel will freely rotate in a forward direction. Only one rear wheel at a given time is the driving wheel. Reversing the direction of armature rotation does not cause the car to reverse its direction of travel but, rather, causes the driving wheel to change from one rear wheel to the other. The transmission system as thus described will never cause the vehicle to travel in the reverse direction but, rather, will always drive the vehicle forwardly.

The front wheel steering means 60 of the present invention will now be described. The armature 31 is supported by a front shaft bearing 34 located in front of the motor 30. The front shaft bearing 34 allows a forwardly extending shaft 62 to pass therethrough which shaft is mechanically connected to and rotates with rotation of the armature 31. In one embodiment of the present invention, the rotating shaft 62 is provided with an enlarged end portion 64. The enlarged end portion 64 is a cylindrical piece of rubber mounted on the rotating shaft 62. As mentioned, tie bar means 22 is provided which serves to maintain the front wheels 14 and 15 in parallel relation. In this embodiment, tie bar means 22 is comprised of an upper tie bar 66 and a lower tie bar 68. Upper tie bar 66 is slightly concave with respect to the enlarged end portion 64 of the shaft 62. Apertures located at the ends of the upper tie bar 66 fit over upwardly extending pivot pins 69 of the lower tie bar. The pivot pins 69 of the lower tie bar couple the tie bar means to the support bars 18. Leg 21 of the support bars 18 is provided with an aperture 70 which fits over pins 69. The pivot pins 69 of the lower tie bar 68 serve to connect the support bars 18 to one another. Lateral displacement of the tie bar means 22, with respect to chassis 12, will thus cause the front wheels 14 and 15 to turn. Significantly, providing a force to turn only one of the front wheels 14 or 15 will cause the other front wheel to correspondingly turn. The tie bar means 22 serves to maintain the wheels in a parallel relation to one another. The enlarged end portion 64 of the forwardly extending shaft 62 sits upon the concave portion of the upper tie bar 66. The upper tie bar is preferably metallic. In operation, rotation of the enlarged end portion 64 causes the upper tie bar 66 to move laterally with respect to the car's forward direction of travel. Frictional engagement between the enlarged end portion 64 of the shaft 62 and the concave portion of the upper tie bar 66 causes this relative lateral movement which causes the front wheels to turn.

The turn limiting means 54 will not be described. The vehicle chassis 12 is provided with two forwardly extending and upwardly projecting ribs 56. These longitudinal ribs 56 guide the vertical displacement of the pick-up shoes and, in addition, limit the degree of turning of the front wheels. Located between ribs 56, the lower tie bar 68 is provided with a forwardly projecting section 57 comprised of two flat surfaces 58. Relative lateral movement of the lower tie bar 68 is limited by the abutment of the flat surfaces 58 against the longitudinal ribs 56 of the vehicle chassis 12. In this manner, the degree or amount that the front wheels may be turned is limited. Obviously, widening the distance between the flat surfaces 58 or decreasing the distance between the longitudinal ribs 56 will further restrict the degree or amount of turning of the front wheels. On the other hand, decreasing the distance between flat surfaces 58 or increasing the distance between longitudinal ribs 56 will allow the wheels to turn to a greater degree. Decreasing the amount that the front wheels will turn will decrease the frictional force between the side wall of the track and the car. The turn limiting means should be adjusted so that a lane change can occur in a minimum amount of time, yet the friction between the car and the side wall of the track is not excessive.

The vehicle chassis 12 is further provided with a lane guide system which serves to prevent inadvertent or accidental contact between the side walls 72 of the track 74 and the chassis 12 or front or rear wheels. Additionally, after a lane change is accomplished, the lane guide system serves to index and align the car's electrical pick-up shoes 37 with the new lane's electricity providing contact rails 76. Thus, the lane guide system helps to immediately provide power to the car after a lane change is accomplished. The spacing means comprises a front bumper 78 and a pair of side guides 80. The front bumper 78 extends across the entire width of the car 10 and is provided with two flanges 82. The width of the front bumper 78 is such that the flanges 82 extend past the outermost portion of the chassis 12, and also beyond the front and rear wheels. The side guides 80 (mirror images of one another) are preferrably attached to the chassis 12 at a point proximate to the permanent magnets 35. Each side guide 80 consists of a relatively straight or flat wall portion 84 and, extending rearwardly therefrom, an outwardly curved wall 86. The contact points 88 of the side guides 80 extend slightly past the vehicle chassis 12, front wheels and rear wheels. The width of the front bumper 78 and the extension of the side guides 80 are such that the contact points 88 of the side guides 86 and the flanges 82 of the front bumper 78 will brush against and contact the side wall 72 of the track. Obviously, only one flange and one contact point will contact the side wall 72 of the track 75 at any one point in time. The lane guide system does not significantly retard the forward travel of the car. Thus, it can be seen that the lane guide system prevents the chassis or wheels from contacting and rubbing against the side walls of the track while still permitting forward travel of the car.

In operation, a track 74 is preferrably comprised of a pair of lanes. The track is further provided with side walls 72 along the outside edges. Each lane is provided with electrical contact rails 76 which serve to provide a source of electrical current to the pick-up shoes 37. By reversing the polarity of the motor, by a remote switching means, the direction of rotation of the armature 31 of the motor 30 can be selectively reversed. Two cars are preferrably provided on the track 74 with each car having its own pair of rails which rails provide electrical power to the motors. When electrical power is provided to the track and the electrical pick-up shoes are placed on the rails, the armature 31 of the motor will rotate in either a clockwise or counterclockwise direction, depending upon the selected polarity of the motor. This armature rotation serves to drive the crown gears 42 and 43 in opposite directions. As previously indicated, however, irrespective of the direction of the rotation of the armature, one of the rear wheels will be the forwardly driving wheel while the other rear wheel will freely rotate forwardly.

For example, if the armature 31 rotates in a clockwise direction, as viewed from the front, then the crown gear 42 will rotate forwardly (clockwise when viewed from the right side of the car) while crown gear 43 will rotate rearwardly (counterclockwise when viewed from the right side of the car). Rear wheel 16 will thus be the driving wheel while rear wheel 17, due to the one-way clutch mechanism, will freely wheel in the forward direction. In this manner, the vehicle will, independent of the front steering means, tend to steer toward the car's right direction, i.e., toward the side wall 72 of the right hand lane illustrated in FIG. 1. Conversely, when the direction of the armature is selectively reversed by reversing the polarity of the motor by a remote switching means, the crown gears will reverse their relative directions. Rear wheel 17 will now be the forwardly driving wheel with rear wheel 16 being the wheel which freely rotates. In this situation, the vehicle will tend to drive toward the left, again, independent of the front steering means, i.e., away from side wall 72 of the track 74 illustrated in FIG. 1.

For the purposes of this example of operation, assume that the motor is first rotating in a clockwise direction, as viewed from the front, and the car is initially located in the right lane of the track. As previously described, the left rear wheel 16 will drive the vehicle while right rear wheel 17 will freely wheel. Since the armature 31 of the motor 30 is rotating in the clockwise direction, the shaft 62 extending forwardly from the armature will likewise rotate in a clockwise direction. The enlarged end portion 64, preferrably rubber, rubs upon and frictionally engages the top surface of the upper tie bar 66. Due to the friction between the end portion and the upper tie bar, the tie bar means 22 will laterally shift (to the left as viewed from the front) with respect to the vehicle chassis 12 and direct the front wheels 14 and 15 so that they point in the direction of steering the car to the right. This clockwise rotation of the armature causes the vehicle to not only travel or be driven forwardly but also causes the vehicle to steer to its right. This steering to the right is accomplished by the left rear wheel being the driven wheel and the front wheels being directed to the right. The right side guide and the right flange of the front bumper will slide against the side wall 72. The vehicle will, however, travel in the forward direction even though the front wheels are maintained to steer in the right direction, i.e., toward the nearest side wall. The lane guide means, in the preferred embodiment comprising the front bumper and side guides, serves to prevent the vehicle chassis 12 and wheels from contacting the side walls 72 of the track. In addition, the lane guide means serves to index the car with respect to the contact rails so that the car's pick-up shoes are located exactly above the electrical contact rails of the lane upon which the car travels.

When the user or operator desires the vehicle to change from the right lane to the left lane, a remote switch, not shown, is deployed which reverses the polarity of the motor and thus causes the rotation of the motor armature 31 to reverse its former clockwise direction and to now rotate in a counterclockwise direction (as viewed from the front). Rotation of the armature 31 in a counterclockwise direction now causes crown gear 43 to rotate forwardly (clockwise when viewed from the right side of the car) and crown gear 42 to rotate rearwardly (counterclockwise when viewed from the right). This causes right rear wheel 17 to become the driving wheel and left rear wheel 16 to freely wheel yet rotate in a forward direction. Causing the right rear wheel to now be the driving wheel facilitates lane changing since, independent of the front wheel steering means, the driving of the right rear wheel, with the left rear wheel freely rotating, will cause the front of the car or chassis to steer left.

The counterclockwise rotation of the armature 31 provides a counterclockwise rotation of shaft 62 and enlarged end portion 64 located at the distal end thereof. Counterclockwise rotation of the enlarged end portion 64, due to its rubbing upon or frictional engagement with upper tie bar 66, causes the tie bar means 22 to laterally shift (to the right when viewed from the front) with respect to the vehicle chassis 12. This lateral movement of the tie bar means 22 causes the front wheels 14 and 15 to move so that they are now directed to steer the car toward the left. Therefore, as has just been described, changing the polarity of the motor will produce the desired result of turning the vehicle from the right lane to the left lane. With the front wheels thus turned, the car will change lanes since there is nothing to restrain the vehicle in the right lane. The lane guide means prevents the vehicle chassis 12 or wheels from contacting the side wall 72 of the left lane. The lane guide means also serves to index the car in the new or left lane of the track so that the pick-up shoes are located immediately above the contact rails of the left lane. The vehicle will continue to be forwardly driven since the current provided to the motor always propels the driving wheels, whether 16 or 17, in the forward direction. Thus, the vehicle is still forwardly driven, but now in the left lane, with the front wheels now turned toward the left lane side wall. The responsiveness of this vehicle or car to a desired lane change is significantly increased over a car without front wheel steering means since, in addition to changing the driving wheel from one side to the other, the direction of the front wheels is changed.

While the front wheels are, after the lane change operation is accomplished, directed toward the side wall 72 of the new lane, thereby forcing the lane guide means to frictionally contact the side walls and slightly impair the speed of the vehicle, the degree of rotation of the front wheels and hence the decrease in the car's speed is substantially limited by the previously described turn limiting means 54. Obviously, the greater the degree that the front wheels turn the car to the side wall, the greater the frictional resistance between the lane guide system and the side wall. Increased frictional resistance retards the speed of the car. The degree of rotation of the front wheels is limited and thus the frictional contact between the side wall and the bumper means is kept to a minimum by the engagement of the flat surfaces 58 with one of the forwardly extending and upwardly projecting ribs 56 of the chassis. In this manner, the front wheels can be turned a sufficient degree to enable the car to change lanes yet the front wheels are prevented from turning beyond a predetermined degree. Thus, the amount of drag of frictional resistance resulting from contact between the side walls and the lane guide means is kept to a minimum. Therefore, the car's speed will be only slightly decreased due to drag resulting from contact between the side walls and the lane guide system.

In the preferred embodiment, as best seen in FIGS. 4 and 5, the rotating shaft 62, extending from the armature 31 of the motor 30, is provided with a worm gear 90. The worm gear 90 is coaxial with the shaft 62 and rotates in the same direction as the rotation of the shaft 62 and armature 31 of the motor. At its end, the worm gear 90 is provided with abutment surfaces 92, in the form of discs. In this embodiment of the invention, the upper tie bar 66 is eliminated. The lower tie bar 68 still, however, maintains the front wheels in parallel relation. A directional rod 94 passes through a slot of one support bar housing 20. One end of rod 94 connects to the first leg of support bar 18. The directional rod is provided with an aperture 98 which fits over pivot pin 28 of support bar 18. Thus, the directional rod pivots about pivot pin 28. Pivoting the rod 94 causes the wheel rotating on the support bar to turn. The free end 100 of the directional rod 94 travels in the grooves 102, i.e., between the threads of the worm gear 90. Displacement of the free end of directional rod 94 will cause the other end of the directional rod, attached to the first leg of support bar 18 to turn. In this manner, displacement of the free end of the directional rod causes the wheel rotating upon the support bar 18 to turn. The tie bar 68 causes both wheels to turn in the same direction to the same degree. The free end of the directional rod 94 will travel forwardly and rearwardly with respect to the direction of travel of the car when the worm gear 90 is rotated in a clockwise and counterclockwise direction, respectively. The degree of rotation or turning of the front wheels is here limited by the abutment surfaces 92 of the worm gear 90. When the free end 100 of direction rod 94 travels the full length of the worm gear 90 and abuts the abutment surface 92, the wheels are then turned to their maximum degree. In this manner, the car 10 is capable of turning and thereby switching lanes, when desired, and yet the amount of frictional resistance caused by contact between the side walls 72 of the track and the lane guide system is minimized.

In operation, assume for the purposes of this example that the motor is turning in a first direction, i.e., clockwise as viewed from the front. This causes the left rear wheel 16 to drive the vehicle and the right rear wheel 17 to freely rotate in a forwardly direction. The clockwise rotation of the armature 31 causes the worm gear 90 to rotate in a similar clockwise direction. Rotation of the worm gear in a clockwise direction causes the free end 100 of the directional rod 94 to travel forwardly. Since the directional rod is pivoted about pivot pin 28, the other end of the directional rod moves rearwardly with respect to the chassis, which causes the front wheels to turn toward the right. Therefore, when the motor is rotated in a clockwise direction, the car 10 will travel forwardly with the left rear wheel driving and the front wheels turned toward the right. When the operator or user desires to change lanes, a remote switch is activated which reserves the polarity of the motor and thus causes the armature rotation of the motor to change to a counterclockwise direction. The right rear wheel will now become the driving wheel with the left rear wheel becoming the freely rotatable wheel. The free end of the directional rod will travel rearwardly along the length of the worm gear. The other end of the directional rod will move forwardly and thereby cause the front wheels to turn toward the left which causes the car to change lanes. After switching lanes the lane guide means again serves to index the pick-up shoes above the contact rails. The vehicle will then drive forwardly by the driving rotation of the right rear wheel with the front wheels turned toward the left, i.e., toward the side wall 72 of the left lane. The degree of turning of the front wheels is limited, however, by the abutment of the free end of the directional rod against the abutment surfaces 92 located at the distal ends of the worm gear.

Another embodiment of the present invention contemplates the use of a pinion gear located at the end of the shaft 62. The pinion gear causes a rack, connected to the lower tie bar, to laterally move with respect to the chassis of the car. The front wheels, therefore, will turn depending upon the direction of rotation of the armature of the motor. This embodiment has not been illustrated in the drawings but should be readily apparent to those skilled in the art.

As will be readily apparent to those skilled in the art, the present invention may be realized in other specific forms without departing from its spirit or essential characteristics. The present embodiments are, therefore, to be considered as illustrative and not restrictive, the scope of the invention being indicated by the claims rather than by the foregoing description, and all changes which come within the meaning and range of equivalence of the claims are therefore intended to be embraced therein.

What I claim is:

1. A miniature toy steerable vehicle comprising: a chassis including at least one front wheel pivotally mounted for steering movement and at least one rear wheel; a reversible electric motor; electrical pick-up means electrically connecting said motor to an external source of electric current; transmission means interconnecting said motor to said rear wheel to propel said vehicle in the forward direction irrespective of the direction of rotation of said motor; and steering means operatively coupling said motor to said front wheel, said steering means instantaneously turning said front wheel in a continuous uninterrupted motion in a first steering direction when the motor rotates in a clockwise direction and instantaneously turning said front wheel in a continuous uninterrupted motion in a second direction when the motor rotates in a counterclockwise direction; said steering means comprising a worm gear connected to and rotatable with said motor, and a directional rod attached at one end to said front wheel, the other end of said directional rod tangentially engaged with said worm gear and traveling in the grooves of said worm gear, whereby displacement of said other end of said directional rod along the length of said worm gear in response to the direction of rotation thereof serves to turn said front wheels to steer said vehicle.

2. A vehicle as claimed in claim 1 wherein said directional rod is formed of resilient material and is biased in contact with said worm gear.

3. A vehicle as claimed in claim 2 wherein said worm gear has limiting means at each end thereof to limit the movement of said directional rod and said directional rod idles at the ends of said worm gear when engaged with said limiting means.

4. A vehicle as claimed in claim 3 wherein, when said directional rod is engaged with said limiting means, said other end of the directional rod moves perpendicular to the axis of said worm gear riding over the threads thereof as said worm gear is rotated by said motor.

5. A vehicle as claimed in claim 1 wherein said motor has an armature and armature shaft and said worm gear is fixedly mounted on said armature shaft.

6. A vehicle as claimed in claim 1 wherein the axis of said front wheel and said directional rod are integral.

7. A vehicle as claimed in claim 1 wherein said directional rod is pivotally mounted on said chassis and connected to said front wheel for steering movement.

* * * * *